United States Patent [19]

Broderick et al.

[11] Patent Number: 4,963,705

[45] Date of Patent: Oct. 16, 1990

[54] TREADLE ASSEMBLY

[75] Inventors: John Broderick, Andover, Mass.; Peter Jones, Londonderry, N.H.; Vincent Squitieri, Billerica, Mass.

[73] Assignee: Chomerics, Inc., Woburn, Mass.

[21] Appl. No.: 336,365

[22] Filed: Apr. 11, 1989

[51] Int. Cl.[5] ..... H01H 21/26

[52] U.S. Cl. ..... 200/86 R; 73/146; 200/302.1; 200/514; 340/666; 340/940

[58] Field of Search ..... 73/146; 307/119, 147, 307/148; 340/666, 933, 940; 200/5 A, 61.43, 85 R, 86 R, 86 A, 512, 514, 302.1, 333

[56] References Cited

U.S. PATENT DOCUMENTS

| | | | |
|---|---|---|---|
| 2,251,351 | 8/1941 | Cooper | 18/59 |
| 2,736,630 | 2/1956 | Cooper | 346/107 |
| 2,858,394 | 10/1958 | Hopkins | 200/86 |
| 2,885,508 | 5/1959 | Wilcox | 200/86 |
| 3,056,005 | 9/1962 | Larson | 200/86 |
| 3,090,941 | 5/1963 | Breese | 340/31 |
| 3,136,833 | 6/1964 | Wikkerink | 264/277 |
| 3,748,443 | 7/1973 | Kroll et al. | 235/92 |
| 3,835,449 | 9/1974 | Viracola | 340/38 |
| 4,178,948 | 12/1979 | Swinehart | 134/45 |
| 4,192,394 | 3/1980 | Simpson | 177/45 |
| 4,455,465 | 6/1984 | Habeger | 200/86 |
| 4,471,177 | 9/1984 | Doughty | 200/5 A |
| 4,483,076 | 11/1984 | Brooks | 33/123 |
| 4,551,595 | 11/1985 | Koenig | 200/86 |
| 4,587,385 | 5/1986 | Capecchi | 200/52 |
| 4,602,135 | 7/1986 | Phalen | 200/5 |
| 4,661,664 | 4/1987 | Miller | 200/86 |
| 4,707,570 | 11/1987 | Ide et al. | 178/18 |
| 4,716,413 | 12/1987 | Haile | 340/933 |
| 4,787,243 | 11/1988 | Gaucher | 73/146 |
| 4,799,381 | 1/1989 | Tromp | 73/146 |

*Primary Examiner*—Gerald P. Tolin

*Attorney, Agent, or Firm*—Celia H. Ketley; William L. Baker

[57] ABSTRACT

The treadle assembly of the present invention comprises one or more lightweight flexible circuits completely sealed within an envelope of resilient elastomeric material. This treadle is thus more resistant to water, wear, road salt, and other environmental factors than conventional treadle assemblies.

23 Claims, 2 Drawing Sheets

TREADLE ASSEMBLY

BACKGROUND OF THE INVENTION

This invention relates generally to treadles which may be used in roadways to sense vehicular traffic flow. The invention is more particularly directed to a treadle assembly containing sealed therein a flexible circuit treadle apparatus designed to resist water and salts, to be longer lasting, easily replaceable, and difficult for vehicles to bypass.

Conventional treadle assemblies generally comprise a rubber treadle envelope containing a pair of contact strips, which are generally heavy metal plates, arranged to actuate a counter, thereby providing a record of the passage of vehicles over a predetermined section of the roadway.

Treadles have generally been utilized for counting of vehicular traffic and are conventionally disposed transversely on a roadway lane so that vehicles in that lane must pass over the treadle. Quite often treadles are placed at toll plazas which may be at a bridge, tunnel, expressway or the like.

Treadles located at such installations are subjected to extreme wear and corrosion as a result of vehicles repeatedly rolling over the same portions of the treadle, and also as a result of frequent exposure to water, salt and other environmental factors. Consequently, the treadles must be frequently replaced.

It is the general practice to replace the treadle assembly as soon as the metal contacts show signs of significant wear. As the treadle assembly is heavy and unwieldy, replacement thereof requires the efforts of several workers for a period of up to a few hours.

Conventional treadle assemblies also are stiff, and thus do not always make contact when depressed, and may be bypassed by vehicles as a result of wide spacing between the contact areas.

The present invention provides a novel treadle assembly containing a lightweight flexible circuit which is pressure sensitive, easy to replace, and difficult to bypass. The circuit is completely sealed in the treadle and is thus more resistant to water, road salt and other environmental factors than conventional treadle assemblies.

SUMMARY AND OBJECTS OF THE INVENTION

The present invention relates to a treadle assembly comprising a resilient envelope adapted to be disposed in a roadway and one or more flexible circuits disposed therein, said flexible circuits containing plurality of pairs of contacts to close under weight of a vehicle passing over the associated treadle contacts and to open when not subject to said weight. Each of said flexible circuits comprises superimposed top and bottom sheets of a resilient flexible material, joined at their edges to form a substantially flat envelope; one or more movable electrically conductive contact means adjacent the top sheet; one or more fixed electrically conductive contact means adjacent the bottom sheet; and a flexible spacer disposed between said fixed and said movable contact means, said flexible spacer material having open areas therein such that when pressure is applied to the treadle assembly at each open area said movable contact means will deflect to engage said fixed contact means at that area.

It is an object of the invention to provide a treadle assembly comprising a resilient envelope adapted to be disposed in a roadway and one or more flexible circuits disposed therein, said flexible circuits containing a plurality of pairs of contacts to close under weight of a vehicle passing over the treadle and to open when not subject to said weight.

It is a further object of the present invention to provide a flexible circuit comprising superimposed top and bottom sheets of a resilient flexible material, joined at their edges to form a substantially flat envelope; a plurality of movable contact means adjacent the top sheet; a fixed contact means adjacent the bottom sheet; a flexible spacer disposed between said fixed and said movable contact mean and having defined open areas therein; and a conductive elastomeric sheet disposed between said spacer and said fixed contacts. Said elastomeric sheet deflects upward when pressure is applied to the treadle surface which provides better contact through the open areas in the spacer material.

A further object of the invention is to provide a lightweight treadle apparatus which can be longer lasting and easily replaced.

Another object of the invention is to provide a treadle apparatus having a plurality of contact areas, spaced apart in a configuration which is difficult to bypass.

An object of the invention is to provide a flexible circuit for a treadle apparatus wherein the open areas of the spacer are arranged in rows across the width of the treadle, and said rows form an angle of 0–55 degrees with the length of the treadle.

Another object of the invention is to provide a treadle apparatus which is resistant to corrosion by water and road salt.

Yet another object of the invention is to provide a treadle switch assembly which is more sensitive to pressure than prior art assemblies thereby providing a more accurate count of vehicular traffic flow.

Additional objects and advantages will become apparent to those skilled in the art as the description proceeds in connection with the accompanying drawings.

BRIEF DESCRIPTION OF THE INVENTION

In carrying out the foregoing objects, this invention provides a treadle assembly comprising a laminated or extruded envelope of resilient elastomeric material adapted to be disposed in a roadway, and having disposed therein one or more flexible circuits. Each of said flexible circuits comprises one or more movable contacts and one or more fixed contacts contained therein. The movable contacts are separated from the fixed contacts by a spacer sheet which contains open areas whereby the passage of a wheel over the treadle causes the upper movable contacts to engage the lower contacts. Said engagement activates a counting means connected to the treadle apparatus by electrical leads attached to the contacts at one or both ends of the length of the treadle. Said fixed and movable contacts are sealed within a substantially flat envelope of flexible, resilient material to prevent attack by water, sand and road salts and additionally to provide a supporting carrier for the thin, flexible contacts.

The foregoing objects of the invention are brought about by the above brief description which will hereinafter be more fully explained in connection with the accompanying figures.

DETAILED DESCRIPTION OF THE INVENTION

Figure 1:
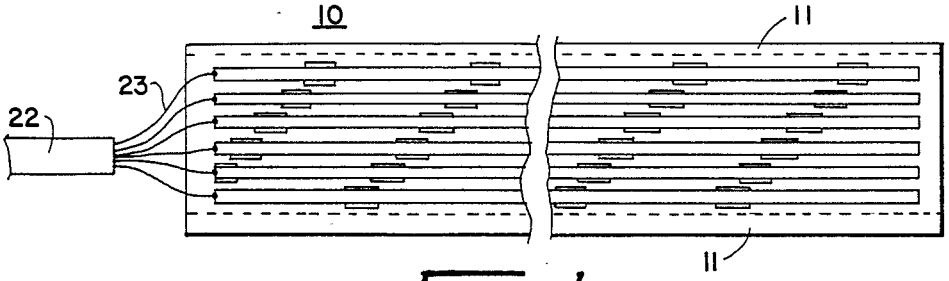
FIG. 1 is a top planar view of the flexible circuit according to one embodiment of this invention.
Figure 2:
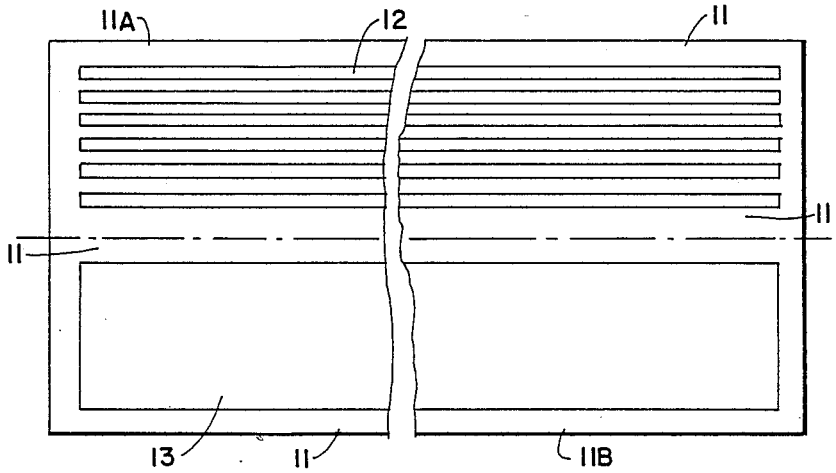
FIG. 2 is a top view of the top and bottom sheets of the flexible circuit with the movable contacts disposed adjacent the top sheet and the fixed contact disposed adjacent the bottom sheet.
Figure 3:
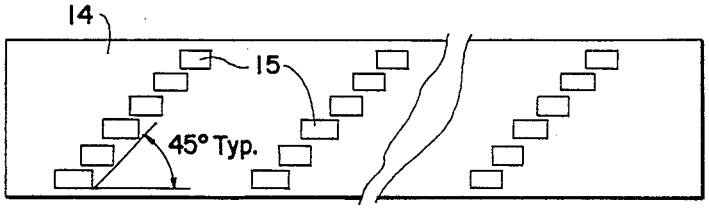
FIG. 3 shows the spacer means according to one embodiment of this invention.
Figure 4:
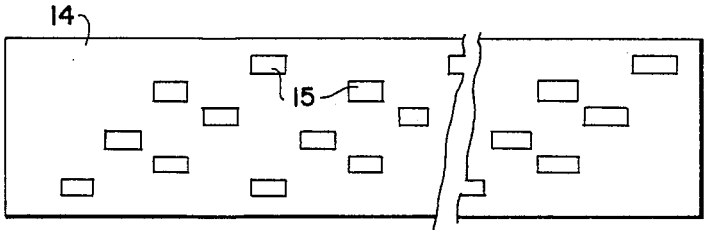
FIG. 4 shows the spacer means according to an alternate embodiment of the invention.

Referring to FIG. 1 there is shown a flexible circuit 10 according to one preferred embodiment, and embodying the principles of this invention. The circuit preferably has a length sufficient to extend substantially across an entire lane of roadway when sealed in the treadle assembly. Generally, this length is at least from about eight feet to about twelve feet. Said circuit apparatus is sealed at its horizontal edges 11. Prior to sealing, leads 23 are attached, preferably by soldering, to the contacts. The leads may be encapsulated at the point of attachment with an appropriate sealant, to further protect the leads from corrosion and contamination by road salt, etc. Said leads generally run into a cable such as flat cable 22. The elements of FIG. 1 will be explained in conjunction with FIG. 2 and FIG. 3, which show the separate layers of the circuit prior to assembly. FIG. 2 shows the top and bottom sheets of flexible material, 11A and 11B, which will be sealed together at the horizontal edges 11, as shown in FIG. 1. Also shown in FIG. 2 are the movable contacts 12 and the fixed contact 13 which are adjacent top sheet 11A and bottom sheet 11B respectively. FIG. 2 shows one embodiment of the invention, in which there are six movable contacts 12 and a single fixed contact 13. However, neither the number of movable contacts nor the number of fixed contacts is critical to the apparatus and thus may be one or more, provided the movable contacts are capable of engaging the fixed contacts. FIG. 3 shows the spacer 14 which separates the movable contacts from the fixed contacts. The spacer 14 contains open areas 15, which in this embodiment of the invention are arranged in a diagonal row which forms an angle of approximately 45 degrees with the length of the spacer 14. Said open areas may be rectangular, as shown in FIG. 3, square, oval or of any other useful shape. In a preferred embodiment of the invention these diagonal rows form an angle of from about 0 to about 55 degrees with the length of the spacer and said rows are spaced from about two to about five inches apart. This arrangement of open areas provides contact areas over a large area of the treadle apparatus, thereby making the treadle difficult for vehicles to bypass. However, other arrangements would be within the principles of the invention. For example, in another embodiment the open areas are arranged as shown in FIG. 4.

Figure 5:
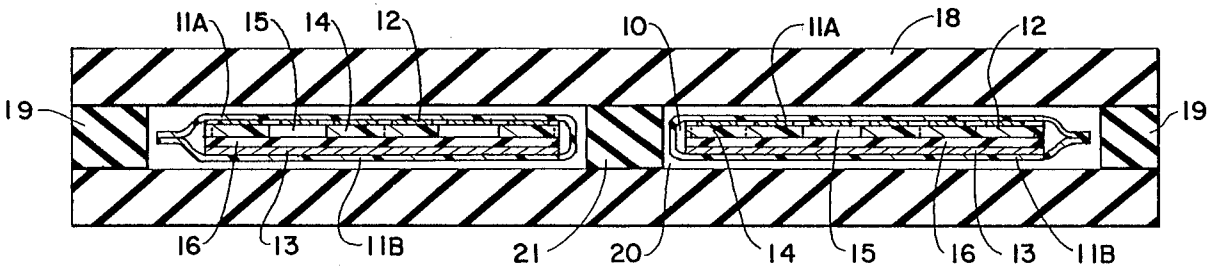
FIG. 5 is a cross-sectional view of a treadle switch assembly according to one embodiment of the invention, having two flexible circuits disposed therein.

In FIG. 5 a cross-sectional view is shown of the assembled treadle apparatus 17 having two flexible circuits 10 disposed therein. Like parts are numbered corresponding to FIGS. 1–3. In this embodiment an additional, optional layer 16 of the flexible circuits 10 is shown. Layer 16 comprises a sheet of conductive elastomeric material which enhances the contact area when the movable and fixed contacts are engaged. It should be noted that the layers are superimposed such that the movable contact strips 12 are aligned with the open areas 15 of the spacer. In an embodiment having multiple fixed contact strips instead of the continuous fixed contact 13, said fixed contacts would also be aligned with movable contacts 12 and open areas 15.

In preferred embodiment of the invention the layers shown in FIG. 5 have the following thicknesses: top and bottom sheets 11A and 11B are of approximately equal thickness, from about 0.002 inches to about 0.030 inches and Preferably about 0.005 inches; movable contacts 12 and fixed contact 13 are of approximately equal thickness, from about 0.002 inches to about 0.020 inches and preferably about 0.002 inches; spacer sheet 14 is of a thickness of from about 0.004 inches to about 0.030 inches and preferably about 0.010 inches, and the conductive elastomeric sheet 16 is from about 0.010 inches to about 0.050 inches and preferably about 0.018 inches. The top and bottom sheets 11A and B and spacer sheet 14 are of a flexible resilient material, for example a flexible polyester sheet known as Mylar®. The fixed and movable contacts may be formed of any electrically conductive material, but are preferably of a metal sheet or foil, e.g. tin plated copper, copper, stainless steel, silver plated copper, nickel, and other conductive metal foils. Preferably, the contacts are permanently laminated to their respective top or bottom sheet. More preferably, the contacts are formed by laminating a solid metal foil to a top or bottom sheet and then the foil is cut by a rotary cutter to create the multiple contact strips. The conductive elastomeric sheet may be any type of electrically conductive elastomeric material, e.g. a silicone elastomer filled with a conductive filler such as silver, silver plated fillers, copper, nickel, carbon black, etc. Such conductive sheets are well known and commercially available, such as CHO-SEAL®, CHO-SIL®or CHO-FOAM® conductive sheet stock, available from Chomerics, Inc.

The layers of the circuit should be sealed at edges 11 in order to prevent the intrusion of water and other contaminants. This could be accomplished using various joining methods well known to those skilled in the art; a preferred method is by application of a pressure sensitive adhesive. Pressure sensitive adhesive may also be used to bond the fixed and movable contacts to the bottom and top sheets respectively, and to bond the spacer sheet to its adjacent layers.

In the embodiment shown in FIG. 5, the treadle assembly comprises two flexible circuit treadle circuits 10 disposed within a treadle envelope of resilient elastomeric material. The resilient treadle envelope can be formed of various elastomeric materials such as natural or synthetic rubbers or synthetic elastomers using conventional methods. In this embodiment the envelope is formed of neoprene rubber which is laminated using a neoprene cement. Top and bottom pieces 18 are laminated at their edges to end pieces 19 and at their centers to spacer 21, leaving two openings 20 into which the treadle switches 10 are placed. The length of the outer resilient envelope formed by 18, 19 and 21 is approximately equal to that of the treadle circuits 10. The width of the outer envelope will be determined by the number of treadle circuits 10 to be used, which may be one or more as well as the width required or desired by the user. Other dimensions are not critical and may be varied to adapt the treadle switch assembly 17 to be disposed in a given roadway surface. In a typical embodiment the elements of the treadle apparatus 17 have the following dimensions: top and bottom pieces 18 are 10.5 inches wide by 100 inches long by 0.50 inches thick; end pieces 19, disposed between top and bottom pieces 18, are 2.0 inches wide by 100 inches long by 0.050 inches thick; spacer 21 is 0.50 inches wide by 100 inches long by 0.050 inches thick. When pieces having the aforementioned dimensions are laminated in the arrangement shown in FIG. 5 two openings 20 are provided having dimensions three inches wide by 100 inches long by 0.050 inches deep into which two treadle circuits 10 are placed.

In other embodiments, the treadle envelope may be an integrally extruded elastomer, an elastomer extruded or molded directly onto a metal plate, or other types of resiliant envelopes.

Since the flexible circuits are completely sealed, they may be used, without an outer envelope, as the treadle assembly itself. However, it is preferred to include the outer envelope in order to further render the treadle resistant to wear, water, road salt and other environmental factors.

While preferred embodiments of this invention have been described in detail hereinabove, it is to be understood that many changes and modifications may be made by those skilled in the art without departing from the scope and spirit of this invention.

What is claimed:

1. A flexible circuit treadle apparatus comprising:

(a) superimposed top and bottom sheets of flexible material joined at their edges to define a substantially flat envelope;

(b) at least one movable electrically conductive contact means disposed immediately adjacent said top sheet;

(c) a flexible spacer material disposed immediately adjacent said movable contact means and having at least one open area therein;

(d) a conductive elastomeric sheet disposed immediately adjacent said flexible spacer material; and (e) at least one fixed electrically conductive contact means immediately adjacent said conductive elastomeric sheet;

whereby as pressure is applied to the treadle apparatus said elastomeric sheet is deflected such that it establishes a conductive path between said fixed and movable contact means; wherein said elastomeric sheet is located between the movable and fixed contact means and wherein each of the elements "b" through "e" above is disposed within the envelope of "a".

2. The treadle apparatus of claim 1 wherein said top and bottom sheets are flexible polyester.

3. The treadle apparatus of claim 1 wherein said movable contact means and said fixed contact means are metal.

4. The treadle apparatus according to claim 1, wherein said top sheet and said bottom sheet are of approximately equal thickness, and said thickness is from 2 mils to 30 mils.

5. The treadle apparatus according to claim 3 wherein said metal is in the form of a sheet having a thickness of from 2 mils to 20 mils and wherein the thickness of the elastomer is from 10 mils to 50 mils.

6. The treadle apparatus of claim 1 wherein the spacer material is a flexible polyester film.

7. The treadle apparatus according to claim 1 wherein said spacer material is of a thickness of from 4 mils to 30 mils.

8. The treadle apparatus of claim 1, wherein a pressure sensitive adhesive is used to join said movable contact means to said top sheet, said fixed contact means to said bottom sheet, said spacer to said movable contact, and the edges of said top and bottom sheets.

9. The treadle apparatus of claim 1, wherein said fixed and said movable contact means are attached respectively to said bottom and top sheets.

10. A flexible circuit treadle apparatus comprising:

(a) superimposed top and bottom sheets of flexible material joined at their edges to define a substantially flat envelope;

(b) from 4 to 8 movable electrically conductive contact means disposed immediately adjacent said top sheet;

(c) a flexible spacer material disposed immediately adjacent said movable contact means and having at least one open area therein;

(d) a conductive elastomeric sheet disposed immediately adjacent said flexible spacer material; and (e) at least one fixed electrically conductive contact means immediately adjacent said conductive elastomeric sheet;

whereby as pressure is applied to the treadle apparatus said elastomeric sheet is deflected such that it establishes a conductive path between said fixed and movable contact means; wherein said elastomeric sheet is located between the movable and fixed contact means and wherein each of the elements "b"through "e" above is disposed within the envelope of "a".

11. The treadle apparatus of claim 10, further comprising a second flexible spacer disposed between said conductive elastomeric sheet and said fixed contacts means.

12. The treadle assembly of claim 11, wherein said second flexible spacer is a flexible polyester film and has a thickness of from 0.001 inches to 0.015 inches.

13. The treadle apparatus of claim 10, wherein said conductive elastomeric layer is from 0.010 inches to 0.050 inches.

14. The treadle apparatus of claim 10, wherein said conductive elastomeric layer is a conductive silicone rubber.

15. The treadle apparatus of claim 10 wherein the open areas of the spacer material form one or more rows across the width of the treadle.

16. The treadle apparatus of claim 15 wherein said rows of open areas in the spacer material form an angle of from 0 degrees to 55 degrees with the length of the treadle.

17. The treadle apparatus of claim 10, wherein said fixed and said movable contact means are attached respectively to said bottom and top sheets.

18. A treadle assembly comprising:

(a) a resilient envelope adapted to be disposed in a roadway; and (b) one or more flexible circuits disposed therein, each said circuit comprising:

(i) superimposed top and bottom sheets of flexible material joined at their edges to define a substantially flat envelope;

(ii) from 4 to 8 movable electrically conductive contact means disposed immediately adjacent said top sheet;

(iii) a flexible spacer material disposed immediately adjacent said movable contact means and having at least one open area therein;

(iv) a conductive elastomeric sheet disposed immediately adjacent said flexible spacer material;

(v) at least one fixed electrically conductive contact means immediately adjacent said conductive elastomeric sheet;

whereby as pressure is applied to the resilient envelope each said elastomeric sheet is deflected such that it establishes a conductive path between the corresponding fixed and movable contact means; wherein said elastomeric sheet is located between the movable and fixed contact means and wherein each of the elements "ii, iii, iv and v" is disposed within the envelope of part "i".

19. The treadle assembly of claim 18, wherein said resilient envelope is a laminated neoprene rubber.

20. The treadle assembly of claim 18 wherein said resilient envelope comprises neoprene rubber and a metal plate.

21. The treadle assembly of claim 18 further comprising one or more electrical leads connected to the flexible circuit to supply a signal to a counting means.

22. The treadle assembly of claim 18, wherein in each circuit the fixed and movable contact means are attached respectively to the corresponding bottom and top sheets.

23. The treadle assembly of claim 18, wherein the resilient envelope is extruded rubber.

* * * * *